US009072330B2

(12) United States Patent
Yoon

(10) Patent No.: US 9,072,330 B2
(45) Date of Patent: Jul. 7, 2015

(54) MAGNETICALLY REPULSIVE SPORT EQUIPMENT

(71) Applicant: Sebastian Yoon, Calgary (CA)

(72) Inventor: Sebastian Yoon, Calgary (CA)

( * ) Notice: Subject to any disclaimer, the term of this patent is extended or adjusted under 35 U.S.C. 154(b) by 93 days.

(21) Appl. No.: 13/850,104

(22) Filed: Mar. 25, 2013

(65) Prior Publication Data

US 2014/0283286 A1 Sep. 25, 2014

(51) Int. Cl.

| | |
|---|---|
| ***A41D 13/00*** | (2006.01) |
| ***A42B 3/06*** | (2006.01) |
| *A41D 13/015* | (2006.01) |

(52) U.S. Cl.

CPC ..... *A42B 3/069* (2013.01); *A41D 13/015* (2013.01)

(58) Field of Classification Search

CPC ..... A41D 13/0002
USPC ..... 2/455, 410–414, 417, 421, 422
See application file for complete search history.

(56) References Cited

U.S. PATENT DOCUMENTS

| | | | |
|---|---|---|---|
| 6,565,147 | B1 | 5/2003 | Beals, Jr. |
| 6,846,270 | B1 | 1/2005 | Etnyre |
| 7,285,336 | B2 | 10/2007 | Raksha et al. |
| 8,191,180 | B2 | 6/2012 | Berry |
| 2012/0000008 | A1 | 1/2012 | Baldackin et al. |
| 2012/0048663 | A1 | 3/2012 | McDonnell |
| 2013/0019384 | A1 | 1/2013 | Knight |
| 2013/0125294 | A1 | 5/2013 | Ferrara |
| 2014/0000012 | A1 | 1/2014 | Mustapha |
| 2014/0013493 | A1 | 1/2014 | Blunt |
| 2014/0215693 | A1 | 8/2014 | O'Gara |
| 2014/0259307 | A1 | 9/2014 | Moss et al. |
| 2014/0259308 | A1 | 9/2014 | Moss et al. |

FOREIGN PATENT DOCUMENTS

| | | | |
|---|---|---|---|
| CA | 2725057 | A1 | 6/2012 |
| CN | 2790847 | Y | 6/2006 |
| CN | 201071026 | Y | 6/2008 |
| CN | 202657791 | U | 1/2013 |
| EP | 2179668 | A1 | 4/2010 |
| FR | 2721272 | A1 | 12/1995 |
| JP | 2004262421 | A | 9/2004 |
| JP | 2007046287 | A | 2/2007 |
| WO | 2011067005 | A1 | 6/2011 |

*Primary Examiner* — Anna Kinsaul
(74) *Attorney, Agent, or Firm* — David A. Guerra

(57) ABSTRACT

The present invention is a sport equipment system for reducing the impact force on sport equipment using magnetic repulsion. The sport equipment system includes sport equipment that is worn by a wearer. The sport equipment has a body, at least one magnetic element associated with the body, and an impact absorbing member configured to receive at least a portion of the magnetic element. The magnetic element has a first pole orientated in a direction exterior of the sport equipment, and is configured to produce a repulsive magnetic force when a second magnetic element of a second sport equipment is at a predetermined distance from the sport equipment prior to the sport equipment contacting the second sport equipment. The magnetic element reduces the impact force prior to a potential impact, and the impact absorbing member reduces the impact force after any impact.

8 Claims, 4 Drawing Sheets

MAGNETICALLY REPULSIVE SPORT EQUIPMENT

BACKGROUND OF THE INVENTION

1. Field of the Invention

The present invention relates to magnetically repulsive sport equipment for use in connection with reducing the impact force on sport equipment by magnetic repulsion.

2. Description of the Prior Art

Athletes that participate in contact sports, such as American football and hockey, are subject to exposure to hyperextension, whiplash-type head movement, axial cervical compressive forces, concussion and subarachnoid hemorrhage. Particular athletes and their playing positions are subjected to greater physical contact per play which can force the athletes head rapidly backward to create a whiplash effect or can incur a strong impact, which can result in serious and disabling injury, and even contribute to death.

According to a research by The New York Times released on Sep. 16, 2007, at least 50 high school or younger football players in more than 20 states since 1997 have been killed or have sustained serious head injuries on the field. A further study published in the September 5$^{th}$ issue of Neurology, indicated that National Football League (NFL) players may face a higher risk of dying from Alzheimer's disease or amyotrophic lateral sclerosis (ALS). This study links the risk to head injuries, even while wearing a protective helmet authorized by the NFL.

Researchers from the National Institute for Occupational Safety and Health in Cincinnati analyzed 3,439 former NFL players who had spent at least five seasons in the league between 1959 and 1988. Of those players, 334 of them had died. Their causes of death were analyzed by researchers, and it was found that seven had died of Alzheimer's and seven had died of ALS. It was also determined that this is nearly four times higher a rate than that of the general population. Thus resulting in a possible direct link between helmet impacts and increase rate of death.

Outside the link between Alzheimer's disease or ALS and head injuries, another type of injury suffered by football players is a concussion. A concussion is defined as an impact to the head that causes a change in mental status. Changes in mental status include memory problems, dizziness, headaches, confusion, and blurred vision or even loss of consciousness. These symptoms may last a few minutes or many days. Not all people who have concussions lose consciousness.

Although football players wear helmets and other protective equipment, many players still suffer concussions. Over the last 20 years there have been studies that indicate that 15-20% of high school football players (200,000-250,000 players) suffer concussions each year. Researchers at the Sports Medicine Research Laboratory at the University of North Carolina analyzed data from 242 schools and 17,549 football players. They found that 888 players (5.1%) had at least one concussion in a season. Of the 888 players who had one concussion, 131 of them (14.7%) had another concussion the same season.

Even though concussions appear to have decreased in the number and severity over the last few years, the overall number of head injuries is still high. As shown by the Sports Medicine Research Laboratory study, players who have one concussion are approximately three times more likely to have a second concussion the same season than those players who have not had an injury. Head injuries jeopardize not only football players' careers, but their future health.

Several types of impact absorbing equipment, such as helmets, have been developed for athletes participating in severe contact sports wherein the player's helmet includes shock absorbing elements or materials to absorb a percentage of the impact force. However, these systems to do not provide proactive repulsion characteristics to the impact prior to contact with the helmet, and they do not provide an active impact deflection prior to contact.

The known impact absorbing helmets are designed to reduce direct impact forces that can mechanically damage an area of contact. Known impact absorbing helmets will typically include padding and a protective shell to reduce the risk of physical head injury. Helmet liners are provided beneath a hardened exterior shell to reduce violent deceleration of the head. These types of protective gear are reasonably effective in preventing injury. Nonetheless, the effectiveness of protective gear remains limited.

While the above-described devices fulfill their respective, particular objectives and requirements, the aforementioned patents do not describe magnetically repulsive sport equipment that allows reducing the impact force on sport equipment by magnetic repulsion.

Therefore, a need exists for new and improved magnetically repulsive sport equipment that can be used for reducing the impact force on sport equipment by magnetic repulsion. In this regard, the present invention substantially fulfills this need. In this respect, the magnetically repulsive sport equipment according to the present invention substantially departs from the conventional concepts and designs of the prior art, and in doing so provides an apparatus primarily developed for the purpose of reducing the impact force on sport equipment by magnetic repulsion.

SUMMARY OF THE INVENTION

In view of the foregoing disadvantages inherent in the known types of impact reducing helmets now present in the prior art, the present invention provides an improved magnetically repulsive sport equipment, and overcomes the above-mentioned disadvantages and drawbacks of the prior art. As such, the general purpose of the present invention, which will be described subsequently in greater detail, is to provide a new and improved magnetically repulsive sport equipment and method which has all the advantages of the prior art mentioned heretofore and many novel features that result in a magnetically repulsive sport equipment which is not anticipated, rendered obvious, suggested, or even implied by the prior art, either alone or in any combination thereof.

To attain this, the present invention essentially comprises a sport equipment system for reducing the impact force on sport equipment using magnetic repulsion. The sport equipment system includes sport equipment that is worn by a wearer. The sport equipment has a body, at least one magnetic element associated with the body, and an impact absorbing member configured to receive at least a portion of the magnetic element. The magnetic element has a first pole orientated in a direction exterior of the sport equipment, and is configured to produce a repulsive magnetic force when a second magnetic element of a second sport equipment is at a predetermined distance from the sport equipment prior to the sport equipment contacting the second sport equipment.

The magnetic element is a plurality of magnetic elements associated with the body at a plurality of locations on the body.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved magnetically repulsive sport equipment that has all of the advantages of the prior art impact reducing helmets and none of the disadvantages.

It is another object of the present invention to provide a new and improved magnetically repulsive sport equipment that may be easily and efficiently manufactured and marketed.

An even further object of the present invention is to provide a new and improved magnetically repulsive sport equipment that has a low cost of manufacture with regard to both materials and labor, and which accordingly is then susceptible of low prices of sale to the consuming public, thereby making such magnetically repulsive sport equipment economically available to the buying public.

Still another object of the present invention is to provide a new magnetically repulsive sport equipment that provides in the apparatuses and methods of the prior art some of the advantages thereof, while simultaneously overcoming some of the disadvantages normally associated therewith.

Even still another object of the present invention is to provide magnetically repulsive sport equipment for reducing the impact force on sport equipment by magnetic repulsion. This allows for proactively reducing the impact force prior to contact between sport equipment.

Lastly, it is an object of the present invention to provide a new and improved method of using a magnetically repulsive sport equipment to reduce an impact force received by a wearer by providing a first sport equipment on a first wearer, and a second sport equipment on a second wearer. The first and second sport equipment each has a body, and at least one magnetic element associated with the body. The magnetic elements each has a pole orientated in a direction exterior of the sport equipment. Then produce a repulsive magnetic force when the magnetic elements are at a predetermined distance from each other prior to the first and second sport equipment making contact.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE INVENTION

Figure 1:
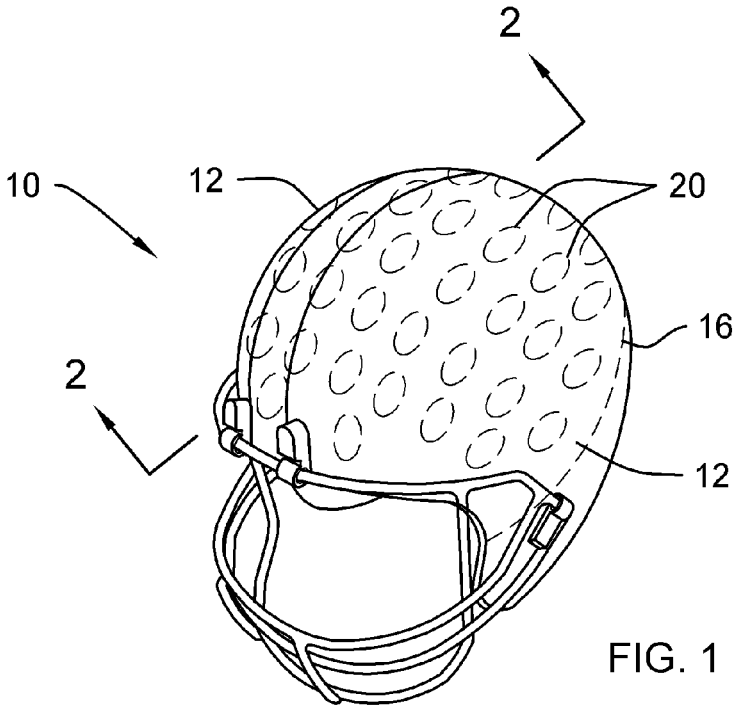
FIG. 1 is a perspective view of an embodiment of the magnetically repulsive sport equipment constructed in accordance with the principles of the present invention, with the phantom lines depicting environmental structure and/or magnetic field.

Referring now to the drawings and particularly to FIGS. 1-8, an embodiment of the magnetically repulsive sport equipment of the present invention is shown and generally designated by the reference numeral 10.

In FIG. 1, a new and improved magnetically repulsive sport equipment 10 of the present invention for reducing the impact force on sport equipment by magnetic repulsion is illustrated and will be described. More particularly, the magnetically repulsive sport equipment 10 can be any sport equipment that receives impact, such as but not limited to, helmets, shoulder protectors, elbow protectors, knee protectors, thigh protectors, hip protectors, shin protectors, wrist protectors, arm protectors, chest protectors, spine protectors, neck protectors, face protectors, torso protectors, and abdomen protectors.

Alternatively, the magnetically repulsive sport equipment 10 can also be sport equipment worn by a player and in combination with sport paraphernalia containing the magnetically repulsive sport equipment, such as but not limited to, baseballs, softballs, bats, hockey pucks, hockey sticks, footballs or polo mallets. The present application will describe, as an example, an embodiment of the present invention as associated with a football helmet 12. However, it can be appreciated that the present invention can be associated with any impact protection equipment. Thus the following exemplary description does not limit the scope of the present invention.

The magnetically repulsive sport equipment 10 can be a helmet 12 that has an outer shell 14, an inner shell or liner assembly 16, and multiple magnetic elements 20 associated with the outer shell 14, inner shell 16 or an area in between the outer and inner shells. The magnetic elements 20 can be associated with an entire or partial surface of the helmet. The magnetic elements 20 are orientated so that each magnetic element 20 has the same pole facing away from the helmet 12. When a second helmet 12' having the same magnetic elements 20' in the same orientation of the first helmet 12 impacts the first helmet 12, the repulsive force produced between the similar poled magnetic elements 20, 20' of the impacting helmets reduces the impact force or deflects the impact. Thus reducing the impact force felt by a person wearing the helmets 12, and reduces the potential of head or neck injury.

The magnetic elements 20 are made from any material that produces a magnetic field or magnetic flux 22 between a north and south pole. However, the magnetic elements 20 may be monopoles, when such technology becomes available. The magnetic field 22 is invisible but produces a force that attracts the opposite pole of other magnets, or repels the same poles of other magnets. The magnetic elements 20 can be made from, but not limited to, ferromagnetic materials, ferromagnetic materials, paramagnetic materials or diamagnetic materials. Ferromagnetic and ferromagnetic materials can be, but not limited to, iron, nickel, cobalt, alloys of rare earth metals, lodestone, alnico, ferrite, gadolinium, dysprosium, magnetite, samarium-cobalt, neodymium-iron-boron (NIB), lanthanoid elements, ceramics or curable resins comprising magnetic materials. Paramagnetic materials can be, but not limited to, platinum, aluminum, oxygen or magnetic ferrofluids. Diamagnetic materials are magnets that are repelled by both poles.

Figure 2:
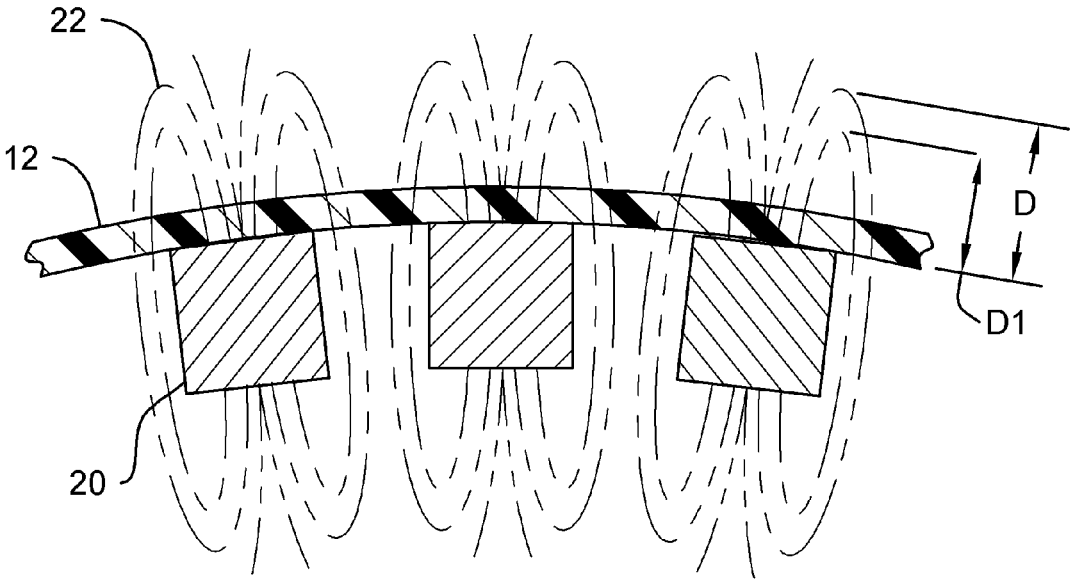
FIG. 2 is a cross-sectional view of a portion of the magnetically repulsive sport equipment of the present invention showing representative magnetic flux lines taken along line 2-2 in FIG. 1.

Each of the magnetic elements 20 produce corresponding magnetic field lines 22, as best illustrated in FIG. 2. The magnetic field lines 22 are substantially contour lines that can be used as a qualitative tool to visualize magnetic forces. For example, in ferromagnetic substances, magnetic force lines 22 can be understood by imagining that the field lines exert a tension, along their length, and a pressure perpendicular to their length on neighboring field lines. Similar poles of the magnet elements 20 of adjacent helmets 12 repel because their field lines 22 do not meet, but run parallel, pushing on each other, thereby producing a repulsive force between the helmets 12. It is known to one skilled in the art that magnetic fields of permanent magnets have no sources or sinks (Gauss's law for magnetism), so their field lines have no start or end: they can only form closed loops, or extend to infinity in both directions.

The magnetic field 22 of each magnetic element 20 will have an attractive or repulsive force that varies from a distance from each pole. The strength of the magnetic field 22 will be less the farther away a magnetic material is from the pole. As illustrated in FIG. 2, each magnetic element 20 produces a corresponding magnetic field force 22 at a distance D from its pole. The magnetic field 22 force is greater at a second distance D1 that is closer to the pole. The outer shell 14 and inner shell 16 of the helmet 12 are typically made from a non-magnetic responsive material, and thus the magnetic fields lines 22 will travel through the outer and inners shells without any deviation in direction or alternation in strength. It can be appreciated that other materials can be associated with the magnetic elements 20, outer shell 14 or inner shell 16 which can control, shield or manipulate the magnetic fields 22 of the magnetic elements 20.

Figure 3:
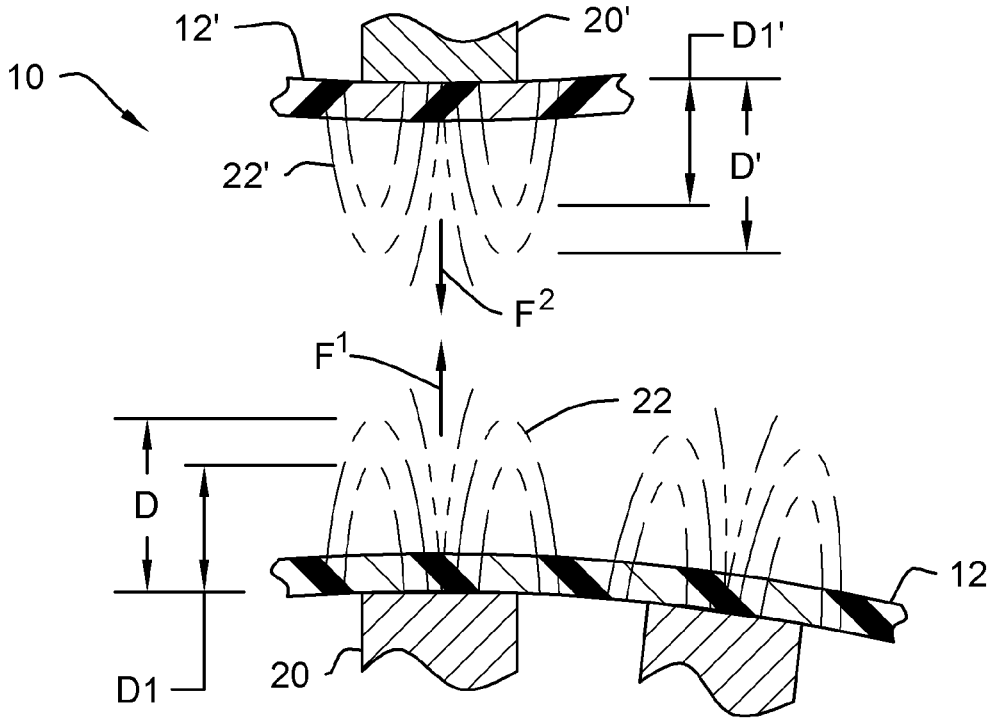
FIG. 3 is a cross-sectional view of a portion of the magnetically repulsive sport equipment of the present invention with force vector lines for a head-on impact.

Referring to FIG. 3, an example of a head-on or direct impact is illustrated. The first helmet 12 produces a repulsive force $F^1$ to a similarly poled second helmet 12' at a distance D, which represents the instant the first magnetic field 22 contacts the second magnetic field 22'. Correspondingly, the second helmet 12' produces a repulsive force $F^2$ to first helmet 12. It can be appreciated that the repulsive forces $F^1$, $F^2$ increase and are interrelated to the distance between the first and second helmets 12, 12'. Thus, the repulsive forces $F^1$, $F^2$ are greater at a distance D1, D1' than at the initial magnetic field contact distance D, D'. The repulsive forces $F^1$, $F^2$ act on both helmets 12, thereby reducing the resultant impact force and reducing potential head or neck injury to wearers of the helmets.

Since the repulsive forces $F^1$, $F^2$ are created at a distance D, D' away from the helmets 12, 12', then the magnetically repulsive sport equipment 10 proactively reduces the resultant impact force prior to impact. The repulsive forces $F^1$, $F^2$ increase in strength as the distance between the impacting helmets 12, 12' gets closer, thus creating a repulsive force that will increasingly reduce the impact force as the distance to impact decreases.

Figure 4:
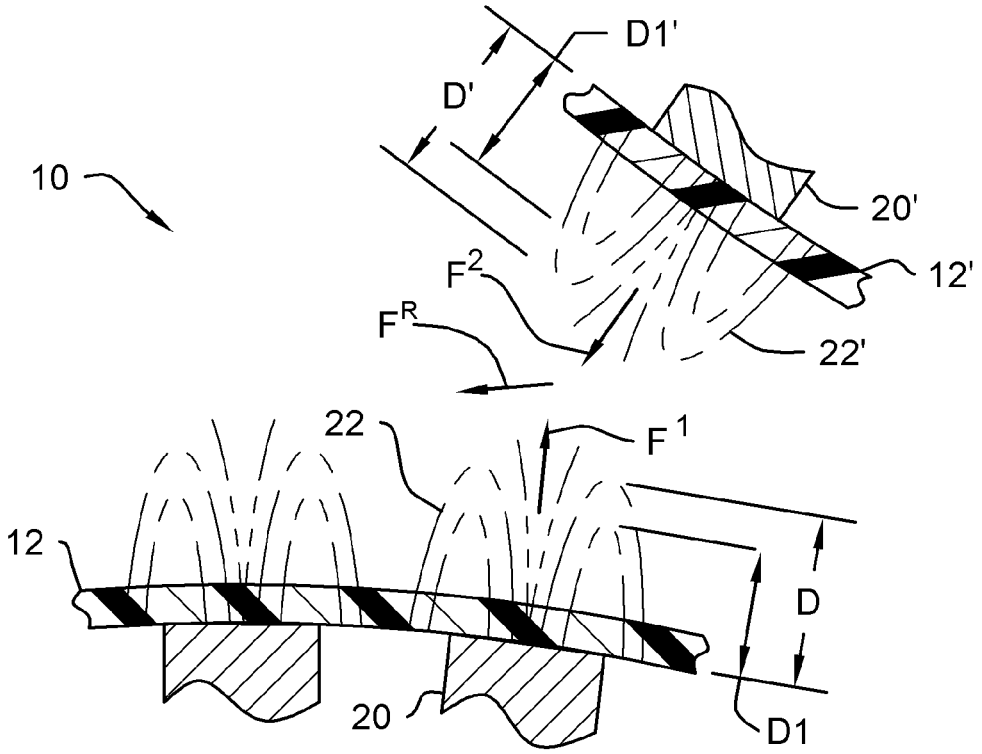
FIG. 4 is a cross-sectional view of a portion of the magnetically repulsive sport equipment of the present invention with force vector lines for an angled impact.

Referring to FIG. 4, an example of an angled impact is illustrated. The first helmet 12 produces a repulsive force $F^1$ to the similarly poled second helmet 12' at a distance D which represents the instant the first magnetic field 22 contacts the second magnetic field 22'. Correspondingly, the second helmet 12' produces a repulsive force $F^2$ to first helmet 12. It can be appreciated that since the repulsive forces $F^1$, $F^2$ are at an angle to each other, then the resultant force vector $F^R$ will be deflected, as per Newton's second law of motion. The deflection of the resultant force vector $F^R$ will increase and change due to the interrelating relationship of the magnetic fields 22, 22' and the distance between the first and second helmets 12, 12'. The resultant force vector $F^R$ translates into a deflection of impact between the first and second helmets 12, 12', thereby reducing the resultant impact force and potential head or neck injury.

The above reduction of impact force between the first and second helmets 12, 12' can be quantified by with the following Equation 1. Equation 1 is valid only for cases in which the effect of fringing is negligible and the volume of the air gap is much smaller than that of the magnetized material:

$$F = \frac{\mu_0 H^2 A}{2} = \frac{B^2 A}{2\mu_0} \qquad \text{Equation 1}$$

where:

A is the area of each surface, in $m^2$;

H is their magnetizing field, in A/m;

$\mu_0$ is the permeability of space, which equals $4\pi\times10^{-7}$ T·m/A; and B is the flux density, in T.

In use with the example illustrated in FIG. 2, and with each magnetic element 20, 20' being two identical cylindrical bar magnets in an end to end configuration representing a head-on impact, Equation 1 is approximately:

$$F = \left[\frac{B_0^2 A^2 (L^2 - R^2)}{\pi\mu_0 L^2}\right]\left[\frac{1}{x^2} + \frac{1}{(x+2L)^2} - \frac{2}{(x+L)^2}\right] \qquad \text{Equation 2}$$

where:

$B_0$ is the magnetic flux density very close to each pole, in T;

A is the area of each pole, in $m^2$;

L is the length of each magnet, in m;

R is the radius of each magnet, in m; and x is the separation between the two magnets, in m.

Equation 3 relates the flux density at the pole to the magnetization of the magnet.

$$B_0 = \frac{\mu_0}{2} M \qquad \text{Equation 3}$$

For two cylindrical magnets 20, 20' with radius R, and height h, with their magnetic dipole aligned, the force can be well approximated (even at distances of the order of h) by:

$$F(x) = \frac{\pi\mu_0}{4} M^2 R^4 \left[\frac{1}{x^2} + \frac{1}{(x+2h)^2} - \frac{2}{(x+h)^2}\right] \qquad \text{Equation 4}$$

Where M is the magnetization of the magnet elements 20, 20' and x is the distance between them. A measurement of the magnetic flux density very close to the magnet $B_0$ is related to M by the formula:

$$B_0=(\mu_0/2)*M \qquad \text{Equation 5}$$

Thus the effective magnetic dipole can be written as:

$$m=MV \qquad \text{Equation 6}$$

Where V is the volume of the magnet, and for this example since the magnets are a cylinder, the volume is $V=\pi R^2 h$.

When h<<x the point dipole approximation is thus obtained by:

$$F(x) = \frac{3\pi\mu_0}{2} M^2 R^4 h^2 \frac{1}{x^4} = \frac{3\mu_0}{2\pi} M^2 V^2 \frac{1}{x^4} = \frac{3\mu_0}{2\pi} m_1 m_2 \frac{1}{x^4} \qquad \text{Equation 7}$$

Equation 7 consequently matches the expression of the force between two magnetic dipoles, which is in correlation to the resultant repulsive impact force between impacting helmets 12, 12' in FIGS. 3 and 4.

Figure 5A:
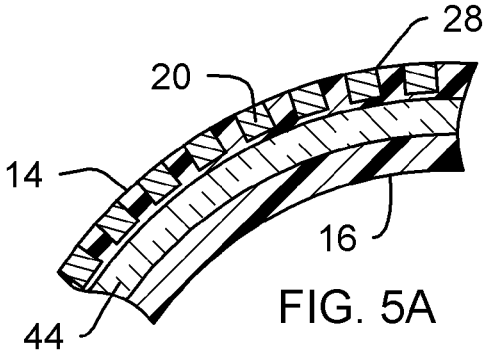
FIGS. 5A-H is a cross-sectional view of a portion of the magnetically repulsive sport equipment of the present invention with alternate embodiment magnetic elements.

Referring to FIGS. 5A-H, alternate embodiment helmets 12 including placements of the magnetic elements 20 and configuration of the inner and outer shells 14, 16 are illustrated. The outer shell 14 of the helmet 12 can include recesses, grooves or notches 28 defined in an exterior surface of the outer shell 14, as best illustrated in FIG. 5A. The magnetic elements 20 are received and securely fitted in the recesses 28 with similar poles facing exterior of the helmet. Positioned between the outer shell 14 and the inner shell 16 can be an impact absorbing material or layer 44. The exterior surface of the outer shell 14 and magnetic elements 20 can be coated or painted. Further padding or linings (not shown) can be adjacent the inner shell 16 interior of the helmet 12.

Figure 5B:
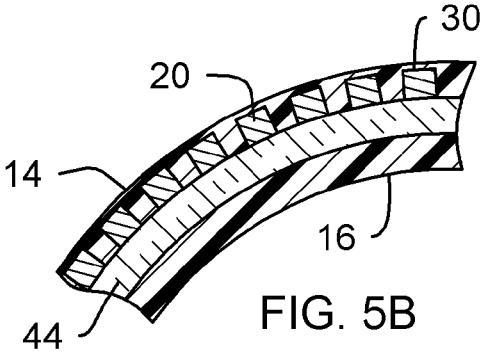

Referring to FIG. 5B, the outer shell 14 of the helmet 12 can include recesses, grooves or notches 30 defined in an interior surface of the outer shell 14. The magnetic elements 20 are received and securely fitted in the recesses 30 with similar poles facing exterior of the helmet. Positioned between the outer shell 14 and the inner shell 16 can be an impact absorbing material or layer 44. Further padding or linings (not shown) can be adjacent the inner shell 16 interior of the helmet 12.

Figure 5C:
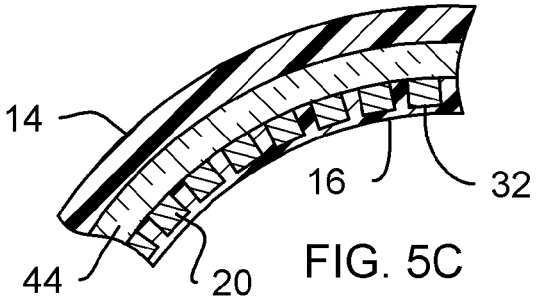

Referring to FIG. 5C, the inner shell 16 of the helmet 12 can include recesses, grooves or notches 32 defined in an exterior surface of the inner shell 16. The magnetic elements 20 are received and securely fitted in the recesses 32 with similar poles facing exterior of the helmet. Positioned between the outer shell 14 and the inner shell 16 can be the impact absorbing material or layer 44. Further padding or linings (not shown) can be adjacent the inner shell 16 interior of the helmet 12.

Figure 5D:
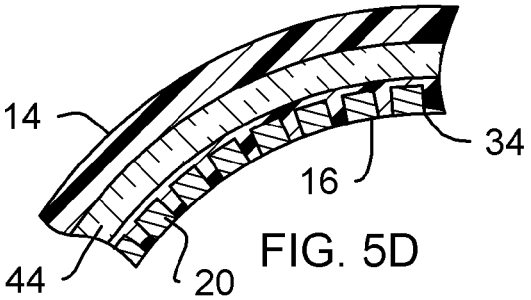

Referring to FIG. 5D, the inner shell 16 of the helmet 12 can include recesses, grooves or notches 34 defined in an interior surface of the inner shell 16. The magnetic elements 20 are received and securely fitted in the recesses 34 with similar poles facing exterior of the helmet. Positioned between the outer shell 14 and the inner shell 16 can be the impact absorbing material or layer 44. Further padding or linings (not shown) can be adjacent the inner shell 16 interior of the helmet 12.

Figure 5E:
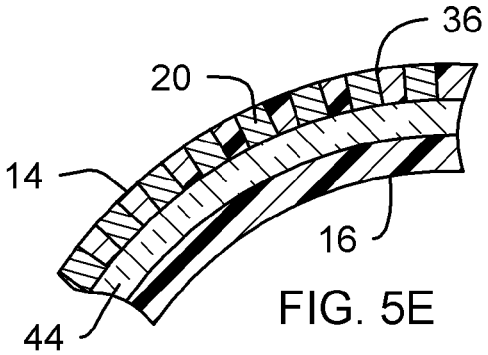

Referring to FIG. 5E, the outer shell 14 of the helmet 12 can include opening, bores or channels 36 defined through the outer shell 14. The magnetic elements 20 are received and securely fitted in the openings 36 with similar poles facing exterior of the helmet. Positioned between the outer shell 14 and the inner shell 16 can be the impact absorbing material or layer 44. Further padding or linings (not shown) can be adjacent the inner shell 16 interior of the helmet 12.

Figure 5F:
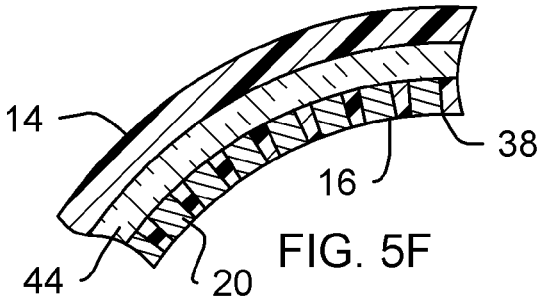

Referring to FIG. 5F, the inner shell 16 of the helmet 12 can include opening, bores or channels 36 defined through the inner shell 16. The magnetic elements 20 are received and securely fitted in the openings 36 with similar poles facing exterior of the helmet. Positioned between the outer shell 14 and the inner shell 16 can be the impact absorbing material or layer 44. Further padding or linings (not shown) can be adjacent the inner shell 16 interior of the helmet 12.

Figure 5G:
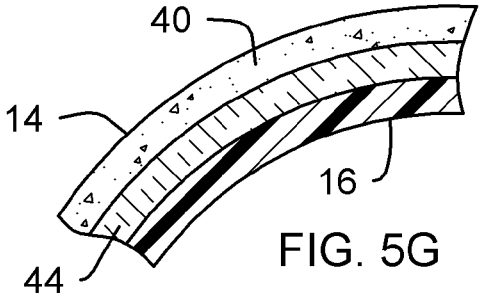

Referring to FIG. 5G, the outer shell 14 of the helmet 12 can be injection molded with magnetic elements or fragments 40 incorporated in a curable resin. Positioned between the outer shell 14 and the inner shell 16 can be the impact absorbing material or layer 44. Further padding or linings (not shown) can be adjacent the inner shell 16 interior of the helmet 12.

Figure 5H:
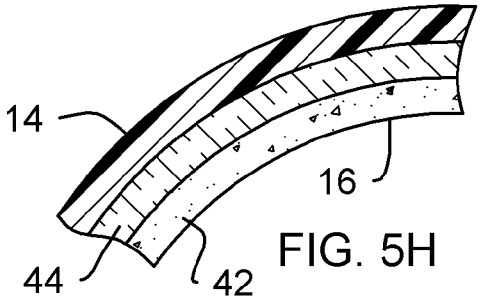

Referring to FIG. 5H, the inner shell 16 of the helmet 12 can be injection molded with magnetic elements or fragments 42 incorporated in a curable resin. Positioned between the outer shell 14 and the inner shell 16 can be the impact absorbing material or layer 44. Further padding or linings (not shown) can be adjacent the inner shell 16 interior of the helmet 12.

It can be appreciated that the exterior or inner surfaces of the outer or inner shells 14, 16 can include a plurality of recess 28, 30, 32, 34 or openings 36, 38 positioned in a variety of locations to maximize the resultant repulsive force. The recess 28, 30, 32, 34 or openings 36, 38 may include means for releasably securing at least one magnetic element 20 therein. Thus providing a user or manufacturer the ability to customize the location of the magnetic elements 20 to produce a predetermine magnetic field 22 map exterior of the helmet 22. Customizing the magnetic field map of the helmet 12 can be beneficial for producing specific helmets for specific player positions that predominately incur impacts at specific locations on the helmets. The means for releasable securing the magnetic elements 20 to the outer or inner shells 14, 16 can be, but not limited to, threaded surfaces, biased latches, adhesives, suction elements or releasable fasteners.

Figure 6:
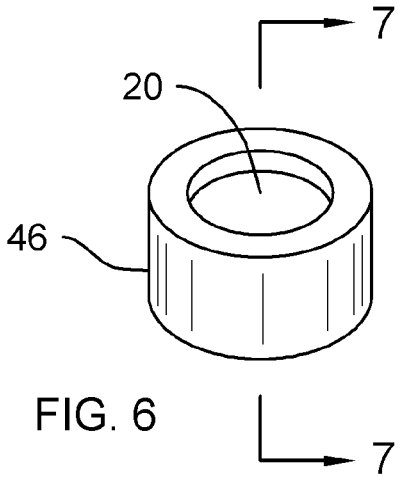
FIG. 6 is a perspective view of the magnetic element in combination with the impact absorbing member of the present invention.
Figure 7:
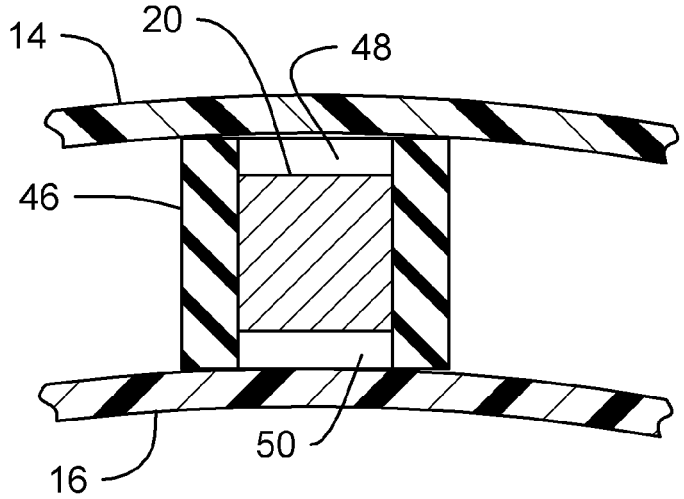
FIG. 7 is a cross-sectional view of the magnetic element and impact absorbing member combination of the present invention taken along line 7-7 in FIG. 6.

Alternatively, as best illustrated in FIGS. 6 and 7, the magnetic elements 20 can be located in an impact absorbing member 46, and placed throughout the helmet 12 between the outer and inner shells 14, 16. It can be appreciated that the impact absorbing member 46 and magnetic element 20 combinations can be in contact with the outer shell 14, inner shell 16 or any combination thereof. The magnetic elements 20 would provide an impact reducing repulsive force prior to impact, while the impact absorbing member 46 would absorb a percentage of the impact force after impact. The impact absorbing member 46 can be made from, but not limited to, rubber, sorbothan, elastomeric materials, foam, impact gel, polymers or laminated materials. The impact absorbing member is shown in FIGS. 6 and 7 having a substantial cylindrical configuration defining a longitudinal bore therethrough.

The impact absorbing member 46 can have a means for releasable securing them to the outer shell 14 and/or the inner shell 16 (not shown). The means can be, but not limited to, threaded surfaces, biased latches, adhesives, suction elements or releasable fasteners. Additionally, the magnetic element 20 can be permanently or releasably fitted to the impact absorbing member 46. The impact absorbing member 46 can have any geometry shape and can have means for releasably connecting to additional impact absorbing member to create an array. It can be appreciated that the inner shell 16 can be an adjustable inner lining or strap system.

Figure 8:
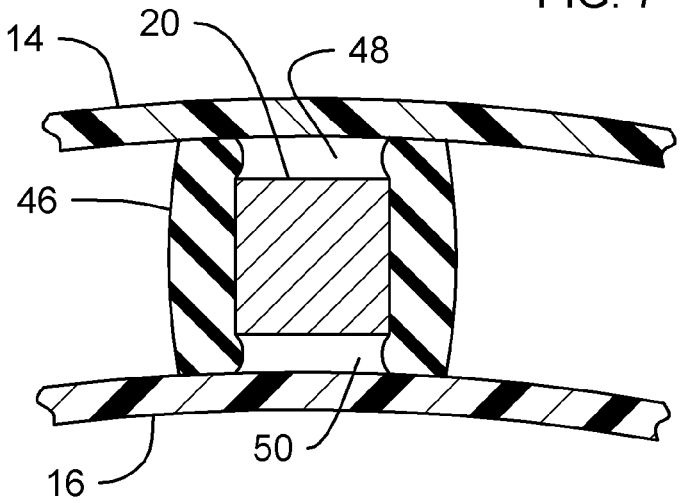
FIG. 8 is a cross-sectional view of the impact absorbing member in a deformed state.

The impact absorbing member 46 can have a height greater than a height of the magnetic element 20 to create an open space, gap or opening 48 adjacent the outer shell 14 and/or an open space, gap or opening 50 adjacent the inner shell 16. The gaps 48, 50 provide space between the outer and inner shells 14, 16 and the magnetic element 20 to prevent direct impact and contact to the magnetic element 20, thereby reducing the chances of damaging the magnetic element 20 and producing splinters that could potentially injure the wearer. It can be appreciated that the magnetic element 20 can be fully encapsulated by the impact absorbing member 46. The gaps 48, 50 are configured to receive a portion of the impact absorbing member 46 that deforms upon impact received by the outer shell 14 and/or the inner shell 16, as best illustrated in FIG. 8.

In use, it can now be understood that the magnetically repulsive sport equipment 10 is used for reducing impact on the human body regarding sport protection equipment, balls, pucks or any combination thereof. A user would don the magnetically repulsive sport equipment, and participate in a sport containing potential impact with another player wearing a magnetically repulsive sport equipment or sport paraphernalia containing the magnetically repulsive sport equipment. Each player or sport paraphernalia would include magnetic elements 20 having similar exteriorly facing poles. Prior to impact, the magnetic fields 22, 22' of potentially impacting magnetic elements 20, 20' would create a repulsive force that will increasingly reduce the impact force as the distance to impact decreases. Thus reducing the impact force received by the wearer of the magnetically repulsive sport equipment 10.

Alternatively, if the potential impact force is directed to the wearer at an angle, then repulsive force produced between the magnetic elements 20, 20' could deflect the impact vector and thereby further reduce the resultant impact force received by the wearer.

While embodiments of the magnetically repulsive sport equipment have been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. And although reducing the impact force on a helmet by magnetic repulsion has been described for exemplary purposes, it should be appreciated that the magnetically repulsive sport equipment herein described is also suitable for reducing impact on the human body regarding other sport protection equipment, or balls or pucks containing the magnetic elements.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected is as follows:

1. A magnetically repulsive sport equipment system for reducing impact force on sport equipment by magnetic repulsion, said magnetically repulsive sport equipment system comprising:

a first sport equipment configured to be worn on a first user, said first sport equipment comprising:

an outer body having an exterior surface and an inner surface;

an inner body in spaced relation with said outer body;

a plurality of impact absorbing members located between said outer body and said inner body, said impact absorbing members each having a substantial cylindrical configuration defining a longitudinal bore therethrough, with a first end of each of said impact absorbing members being in contact with said inner surface of said outer body; and a first magnetic element located in said longitudinal bore of each of said impact absorbing members so as to define a gap between said first magnetic element and said inner surface of said outer body at said first end of said impact absorbing member, respectively, said first magnetic element having a first pole orientated in a direction exterior of said outer body of said first sport equipment; and a second sport equipment not provided on the first user, said second sport equipment having a second magnetic element having a first pole orientated in a direction exterior of said second sport equipment;

wherein said first magnetic element of said first sport equipment is configured to produce a repulsive magnetic force with said second magnetic element of said second sport equipment at a predetermined distance from said first sport equipment prior to said exterior surface of said outer body of said first sport equipment contacting said second sport equipment;

wherein said gap being configured to receive a portion of said first end of said impact absorbing member, respectively, deformed upon said outer body receiving a predetermined impact force from said second sport equipment to prevent said inner surface of said outer body contacting said first magnetic element.

2. The magnetically repulsive sport equipment system as claimed in claim 1, wherein said second sport equipment is configured to be worn on a second user.

3. The magnetically repulsive sport equipment system as claimed in claim 1, wherein said first sport equipment further comprising a plurality of additional magnetic elements attached to said inner body.

4. The magnetically repulsive sport equipment system as claimed in claim 1, wherein said first sport equipment further comprising a plurality of additional magnetic elements attached to said outer body.

5. The magnetically repulsive sport equipment system as claimed in claim 1, wherein said first sport equipment further comprising a plurality of additional magnetic elements impregnated in said outer body.

6. The magnetically repulsive sport equipment system as claimed in claim 1, wherein said first sport equipment is a helmet configured to be worn by the first user.

7. The magnetically repulsive sport equipment system as claimed in claim 1, wherein said first magnetic element being located in said longitudinal bore of each of said impact absorbing members so as to define a second gap between said first magnetic element and an outer surface of said inner body at a second end of said impact absorbing member, wherein said second gap is configured to receive a second portion of second end of said impact absorbing member, respectively, deformed upon said outer body receiving said predetermined impact force from said second sport equipment to prevent said outer surface of said inner body contacting said first magnetic element.

8. A method of using a magnetically repulsive sport equipment system to reduce an impact force received by a user of said magnetically repulsive sport equipment system, said method comprising the steps of:

a) placing a first sport equipment on a first user so that an outer body of said first sport equipment is exterior of the first user and an inner body of said first sport equipment is toward the first user, said first sport equipment including a plurality of first impact absorbing members located between said outer body and said inner body, and at least one first magnetic element located in a longitudinal bore defined through each of said first impact absorbing members so as to define a gap between said first magnetic element and an inner surface of said outer body at a first end of said first impact absorbing member in contact with said inner surface, and wherein said first magnetic element having a first pole orientated in a direction exterior of said outer body of said first sport equipment;

b) placing a second sport equipment on a second user so that an outer body of said second sport equipment is exterior of the second user and an inner body of said second sport equipment is toward the second user, said second sport equipment including a plurality of second impact absorbing members located between said outer body and said inner body of said second sport equipment, and at least one second magnetic element located in a longitudinal bore defined through each of said second impact absorbing members so as to define a gap between said second magnetic element and an inner surface of said outer body of said second sport equipment, wherein said second magnetic element having a first pole orientated in a direction exterior of said outer body of said second sport equipment, and wherein said first pole of said second magnetic element is the same as said first pole of said first magnetic element;

c) reducing an impact force prior to contact between said first sport equipment and said second sport equipment when at a predetermined distance between each other by a repulsive magnetic force produced between said first magnetic element and said second magnetic element; and d) deforming a portion of said first end of at least one of said first and second impact absorbing members into said gap, respectively, upon contact between said first sport equipment and said second sport equipment.

* * * * *